US006922958B2

(12) United States Patent
Derderian

(10) Patent No.: US 6,922,958 B2
(45) Date of Patent: Aug. 2, 2005

(54) WINDOW CONSTRUCTION WITH INTEGRATED SILL AND CASING AND METHOD OF MAKING SAME

(75) Inventor: James V. Derderian, Windham, NH (US)

(73) Assignee: Merrimack Valley Wood Products, Inc., Derry, NH (US)

( * ) Notice: Subject to any disclaimer, the term of this patent is extended or adjusted under 35 U.S.C. 154(b) by 83 days.

(21) Appl. No.: 10/411,626

(22) Filed: Apr. 11, 2003

(65) Prior Publication Data

US 2004/0200160 A1 Oct. 14, 2004

(51) Int. Cl.[7] ..... E06B 3/00

(52) U.S. Cl. ..... 52/204.55; 52/211; 52/656.5; 52/208

(58) Field of Search ..... 52/204.5, 208, 52/204.55, 204.53, 204.54, 211, 212, 213, 656.2, 656.5, 656.7, 656.6, 745.16

(56) References Cited

U.S. PATENT DOCUMENTS

| | | | | |
|---|---|---|---|---|
| 3,271,902 A | * | 9/1966 | Dwnsanoor et al. | 49/483.1 |
| 3,991,806 A | | 11/1976 | Abell | |
| 4,068,428 A | | 1/1978 | Peterson, III | |
| 4,133,367 A | | 1/1979 | Abell | |
| 4,491,936 A | | 1/1985 | Eaton, Jr. et al. | |
| 4,563,846 A | | 1/1986 | Webb | |
| 4,586,291 A | | 5/1986 | Swan | |
| 4,642,955 A | | 2/1987 | Webb | |
| 4,694,612 A | | 9/1987 | Pruden et al. | |
| 4,793,107 A | | 12/1988 | Pacca | |
| 4,856,239 A | * | 8/1989 | Elsasser | 52/98 |
| 4,924,631 A | * | 5/1990 | Davies et al. | 49/504 |
| 5,007,219 A | * | 4/1991 | Sayer | 52/204.55 |
| 5,083,409 A | * | 1/1992 | Pliml, Jr. | 52/656.9 |
| 5,115,605 A | | 5/1992 | Butler | |
| 5,223,484 A | * | 6/1993 | Fleming et al. | 514/14 |
| 5,265,388 A | | 11/1993 | Sherwood | |
| 5,392,574 A | | 2/1995 | Sayers | |
| 5,440,847 A | | 8/1995 | Butler | |
| 5,471,803 A | | 12/1995 | Logan et al. | |
| 5,660,010 A | * | 8/1997 | Sayers | 52/217 |
| 5,779,384 A | * | 7/1998 | Olsen | 403/231 |
| 5,839,234 A | | 11/1998 | Mayer | |
| 6,055,782 A | | 5/2000 | Morton et al. | |
| 6,182,405 B1 | * | 2/2001 | Lindahl | 52/204.1 |
| 6,276,099 B1 | | 8/2001 | O'Shea | |
| 6,305,144 B1 | | 10/2001 | Stevens | |
| 6,334,283 B1 | | 1/2002 | Edger | |
| 6,409,868 B1 | | 6/2002 | Edger | |
| 6,427,398 B1 | | 8/2002 | Levine et al. | |
| 6,745,523 B2 | * | 6/2004 | Petta | 52/213 |
| 2003/0056450 A1 | * | 3/2003 | Bealko | 52/204.55 |
| 2003/0226320 A1 | * | 12/2003 | Engebretson | 52/204.5 |
| 2003/0226321 A1 | * | 12/2003 | Engebretson | 52/204.54 |

OTHER PUBLICATIONS

Paradigm Windows Solutions, "24 Standard Designer DH FlatCasing VinylSiding," (visited Jan. 3, 2003) <http://www.paradigmwindows.com>.

* cited by examiner

*Primary Examiner*—Brian E. Glessner
(74) *Attorney, Agent, or Firm*—McLane, Graf, Raulerson & Middleton, PA

(57) ABSTRACT

An improved plastic, e.g., vinyl, window construction includes an exterior casing rigidly mounted to a window frame and which may advantageously be preattached to the window frame, allowing the window construction to be installed as a single unit. The exterior casing may include an exterior sill and may be constructed to provide the appearance of a traditional wooden window. In another aspect, a window construction with an integrated interior casing is also provided. In yet a further aspect, a method for manufacturing a plastic window construction with integrated exterior casing is provided.

31 Claims, 6 Drawing Sheets

WINDOW CONSTRUCTION WITH INTEGRATED SILL AND CASING AND METHOD OF MAKING SAME

BACKGROUND OF THE INVENTION

The present invention relates generally to a window construction for mounting in the walls of buildings such as homes and the like and, more particularly, to an improved window construction or module having integrated sill and casing members. Although the invention will be shown and described herein primarily by way of reference to double hung windows, it will be recognized that the present invention is equally applicable to all manner of windows, including but not limited to, single-hung windows, casement windows, sliding windows, bay windows, picture windows, curved windows, round windows, and other types of residential and commercial windows.

Window assemblies in both the new construction and replacement window markets commonly incorporate plastic materials and it is known to manufacture windows and window components entirely from plastic, most typically vinyl, i.e., from extruded members which are cut and assembled to form the window frame, sashes, and so forth. Such window assemblies typically include multiple components which must be installed and secured to each other on site, thereby increasing the time and labor cost for installation. Furthermore, such materials lack the often-desired traditional appearance of wooden windows having a wooden exterior sill and wooden exterior casing. Where a traditional appearance is desired for plastic window installations, wooden or synthetic exterior casings and sill members may be applied by craftsmen in the field, thus increasing the cost of installing the windows.

Also, an interior casing/extension jamb is conventionally applied after the window has been installed into the rough window opening to give a desired finished appearance on the interior side of the window. This likewise requires skilled craftsmen to apply, thus increasing the cost and time for installation of the windows.

When multiple components are installed in the field, sealing members such as gaskets, adhesives, caulking, and the like must also be installed on-site for the protection against the entry of moisture or other environmental contamination.

The present invention provides a new and improved window construction and method that overcome the above-referenced problems and others.

SUMMARY OF THE INVENTION

In one aspect, a window construction for mounting in an opening in a wall of a structure includes a window frame for being received in said opening in the wall. An integrated exterior casing is fastened to said frame and has a mounting face on an inwardly facing surface thereof for engagement and rigid mounting against an aligned, outwardly facing surface of the window frame.

In another aspect, a window construction comprises a rectangular window frame for being received in the opening in the wall. The window frame includes upper and lower horizontally extending frame members and first and second vertically extending frame members. The window frame is adapted to carry one or more window sashes. The window construction further comprises an integrated exterior casing, which includes a first exterior casing member fastened to the upper horizontally extending frame member and second and third integrated casing members fastened to the first and second vertically extending frame members, respectively. Also, an integrated exterior sill is attached to the lower horizontally extending frame member. The integrated exterior casing and the integrated exterior sill combine to circumscribe the window frame. Each of the first, second, and third exterior casing members and the exterior sill member have a mounting face on an inwardly facing surface thereof for engaging and rigid mounting against an aligned, outwardly facing surface of the window frame.

In another aspect of the present invention, a method for manufacturing a window construction for installation within an opening formed in a wall of a structure comprises forming a window frame for being received in said opening in the wall and forming an integrated exterior casing. Prior to installing the window construction in the opening in said structure, the integrated exterior casing is attached to the window frame.

In still another aspect, a method for manufacturing a window construction for installation within an opening formed in a wall of a structure is provided. A rectangular window frame having upper and lower horizontally extending frame members and first and second vertically extending frame members and adapted to carry one or more window sashes is formed for being received in the opening in the wall. An integrated exterior casing is formed and comprises a first exterior casing member for attachment to the upper horizontally extending frame member and second and third integrated casing members for attachment to the first and second vertically extending frame members, respectively. An integrated exterior sill is formed for attachment to the lower horizontally extending frame member. Prior to installing the window unit in the opening in the structure, the integrated exterior casing and integrated exterior sill are attached to the window frame. The exterior casing and exterior sill thus combine to circumscribe the window frame.

In yet another aspect, a window construction for mounting in an opening in wall of a structure is provided including a rectangular window frame for being received in the opening in the wall. The window frame has upper and lower horizontally extending frame members and first and second vertically extending frame members and is adapted to carry one or more window sashes. An integrated exterior casing includes a first exterior casing member fastened to the upper horizontally extending frame member and second and third integrated casing members fastened to the first and second vertically extending frame members, respectively. An integrated exterior sill is attached to the lower horizontally extending frame member. The integrated exterior casing and integrated exterior sill circumscribe the window frame. Each of the first, second, and third exterior casing members have an exterior-most exterior facing surface which is substantially flush with an adjacent, exterior facing surface of the window frame.

One advantage of the present invention resides in the fact that window installation is simplified. By integrating the exterior sill and casing and, optionally, the interior casing into the window module, the time consuming and potentially more cumbersome steps of installing these components on-site is eliminated.

Another advantage is that window assembly is made faster, less sensitive to operator error, more suited to centralized or automated assembly procedures, thereby reducing possible failure modes and warranty issues.

Still another advantage of the invention resides in the provision of a window module which gives the appearance of a traditional wooden window.

Yet a further advantage is found in the large contact area between the window frame and the integrated exterior casing and sill, thereby allowing rigid mounting therebetween.

Still further benefits and advantages of the invention will become apparent to those of ordinary skill in the art upon reading and understanding the following detailed description of the preferred embodiments.

It is to be understood that both the foregoing general description and the following detailed description are exemplary and explanatory only and are not restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The following detailed description may be best understood when read in reference to the accompanying drawings wherein.

DETAILED DESCRIPTION OF THE PREFERRED EMBODIMENTS

Figure 1:
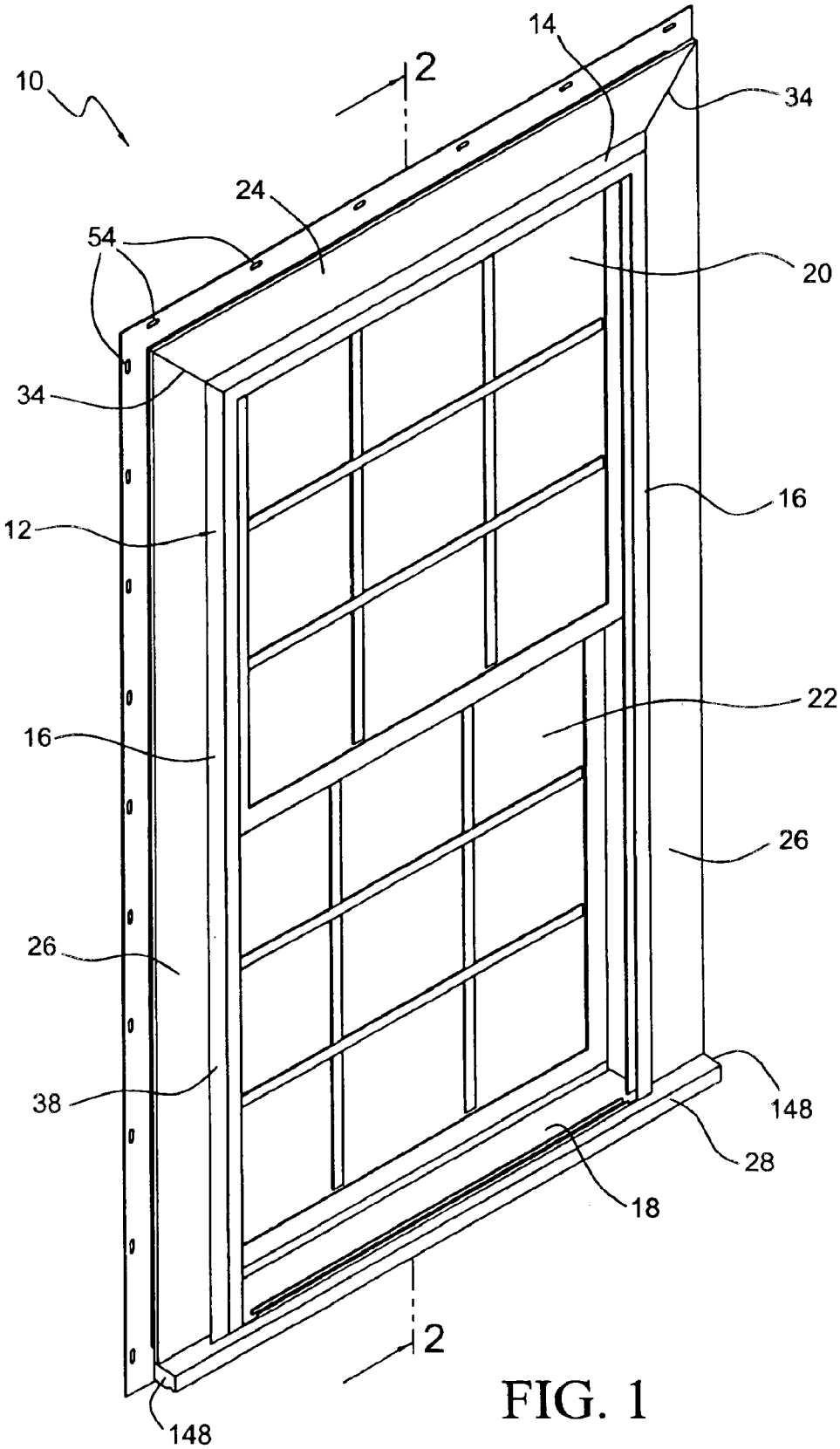
FIG. 1 is a perspective view of a window module with integrated exterior sill and casing members in accordance with a preferred embodiment of the present invention.

Referring now to the drawings, wherein like reference numerals refer to like components throughout the several views, there appears a window construction 10 (as viewed from the exterior in FIG. 1) according to an exemplary embodiment of the present invention.

Unless indicated otherwise, all directional or positional terms used herein, such as "upper," "lower," "horizontal," "vertical," etc., and variations thereof refer to a direction or orientation relative to the window as it is intended to be installed in a building or structure. Thus, "exterior" and "interior" and variant forms thereof refer to directions or orientations relative to the exterior and interior, respectively, of the building or structure in which the window is to be installed. The terms "inward" and "outward, and variant forms thereof, will be used to refer to directions or orientations which are generally along the plane of the window, with the term "inward" and variants thereof referring to a direction or orientation relative to more central portion of the bounded area of the window unit or window opening, and with "outward" and variants thereof referring to a direction or orientation away from a central portion of the bounded area of the window unit or window opening. Finally, the terms "axial," "axially," etc., refer to directions generally parallel to a longitudinal axis of a referenced elongate member, such as the frame members, exterior casing members, and exterior sill members.

The window construction 10 comprises four sections which are attached to form a frame 12. The attachment may be made via mechanical fasteners, welding (e.g., ultrasonic or, more preferably, hot welding), bonding, or any combination thereof. The four sections are preferably formed via an extrusion process, although other methods of forming the frame sections, such as molding, are also contemplated. Although the present invention is described by way of reference to a rectangular window, it will be recognized that the window frame and exterior casing may include one or more curved sides or members. For example, the curved frame and exterior casing sections may be bent to a desired shape or radius, e.g., during or after the extrusion process, molding the sections to the desired shape, and so forth.

The four frame sections include an upper or head frame section 14, a pair of vertically extending side or jamb frame sections 16, and a lower or sill frame section 18. The window module 10 further includes upper and lower sashes 20 and 22, respectively. The sashes 20 and 22 are slideably received within the window frame 12, e.g., within tracks or guide rails 32 formed on or attached to the side frame sections 16. Additionally, the sashes may carry certain hardware components, such as locks, release mechanisms for removing the sashes, environmental barriers, and the like. A lip 38 may also be provided to retain an optional screen or storm window (not shown).

An upper exterior casing member 24 and two vertically extending side exterior casing members 26 are attached to the respective upper and side frame sections 14 and 16. An exterior sill member 28 is attached to the lower frame member 18. The exterior casing and sill members are likewise preferably formed via an extrusion process, although other methods, such as molding, are also contemplated.

Figure 2:
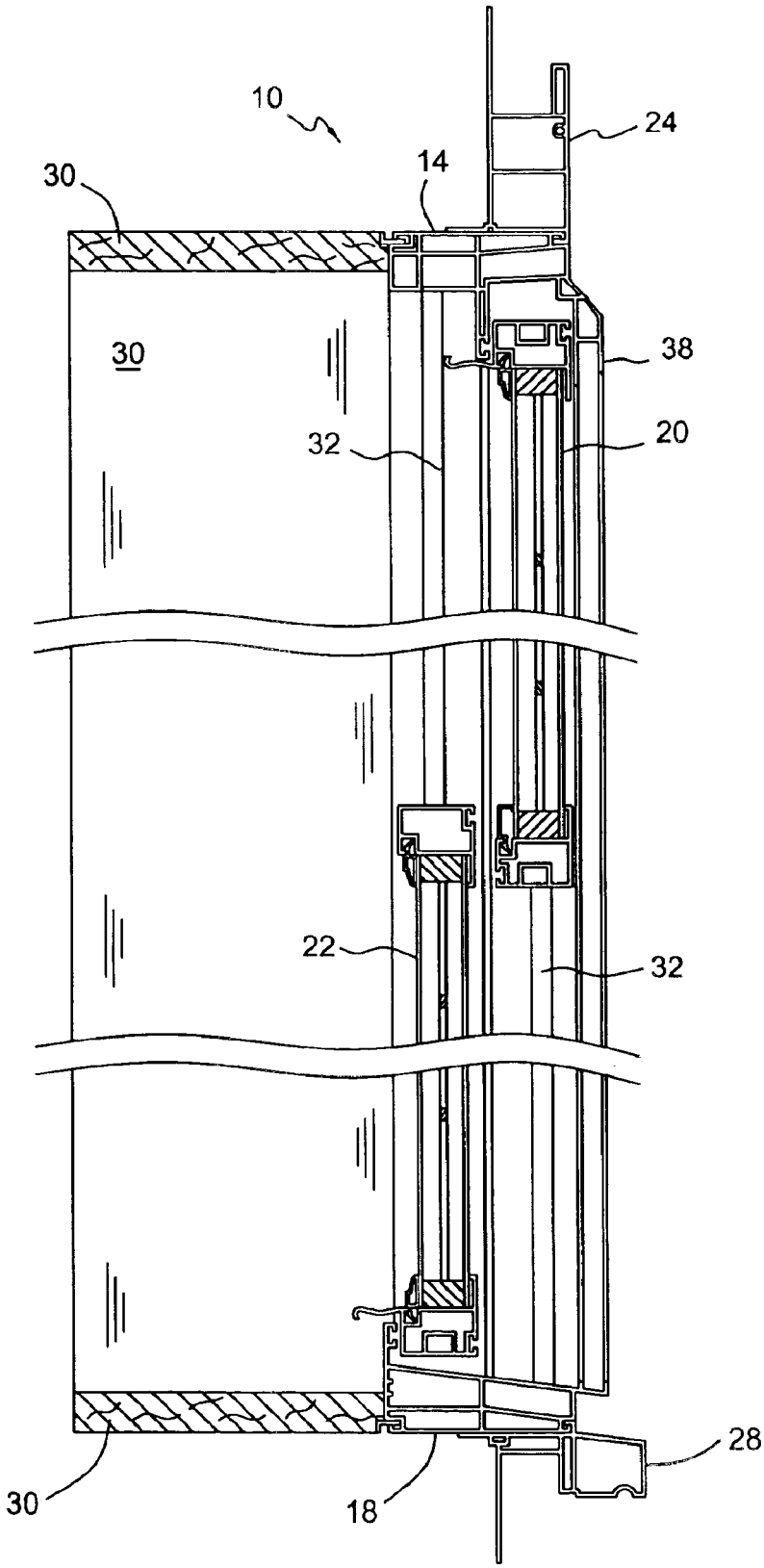
FIG. 2 is side-sectional view taken along the lines 2—2 of FIG. 1.

As best shown in FIG. 2, the depicted exemplary embodiment shows interior casing members 30, which may optionally be pre-attached to the frame 12 during the manufacture of the window, e.g., at a window assembly plant or other centralized location.

The depicted window frame members 14, 16, and 18 according to a preferred embodiment are adapted to receive both the respective integrated exterior casing members 24, 26, and exterior sill member 28, as well as the optional interior casing members 30.

Figure 3:
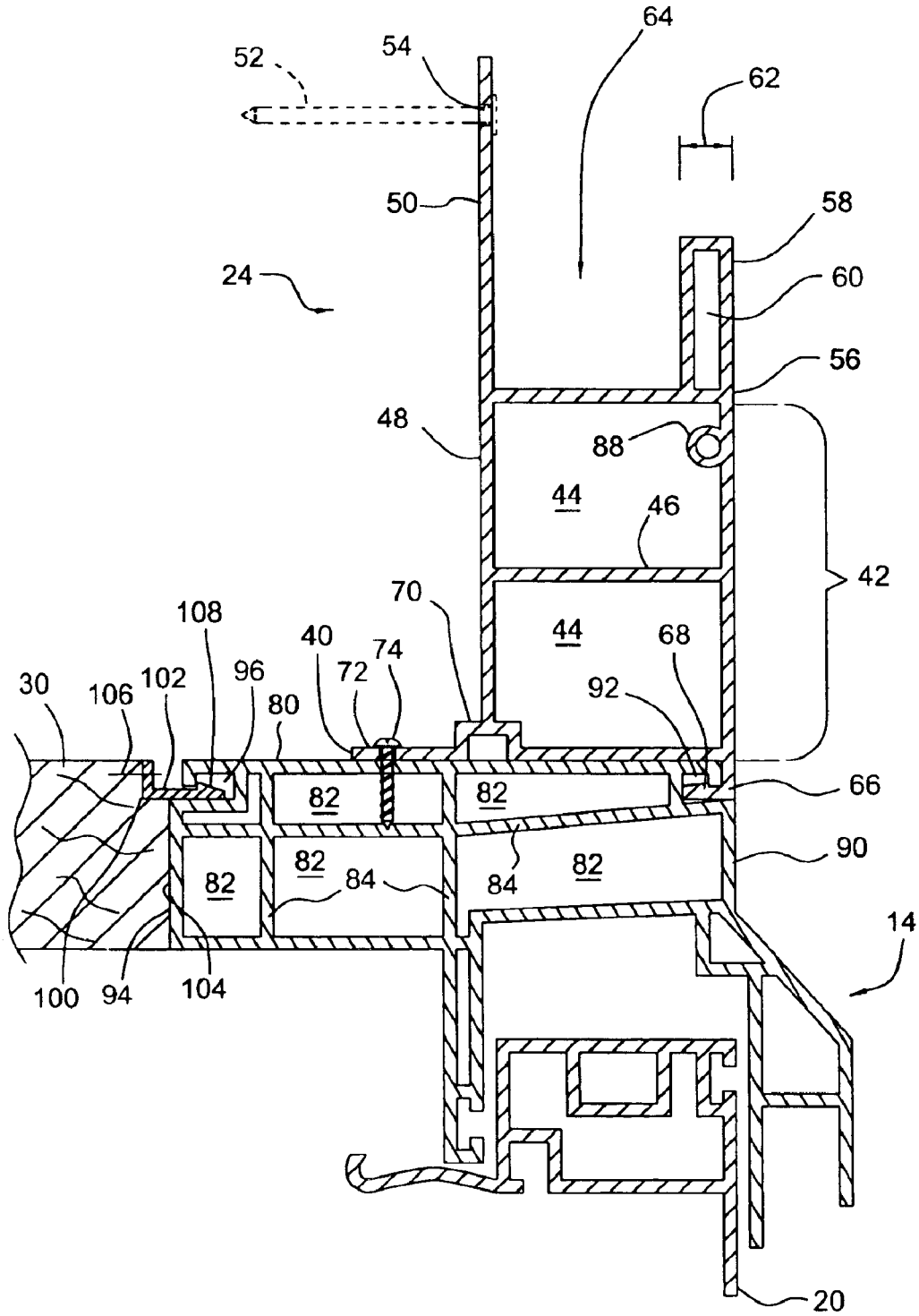
FIG. 3 is an enlarged side-sectional view illustrating an exemplary exterior casing member profile and means of attachment to the window frame.

The cross-sectional profiles of the window frame member 14 and the exterior casing member 24, and their manner of attachment, are best seen in FIG. 3. However, the discussion below with respect to window frame member 14 and casing member 24 is equally applicable to the vertically extending members 16 and 26, as well.

Again, the window frame members 14, 16, and 18 as well as exterior casing members 24 and 26 and exterior sill member 28 are preferably formed by extruding a plastic material, preferably vinyl. It will be recognized that the extrusion profiles are not limited to the specific embodiments shown and other geometrical cross-sectional configurations are also contemplated.

The exterior casing member 24 includes a base layer or mounting surface 40 and a main body portion 42. The main body portion includes axially extending hollow regions 44 and one or more interior structural panels 46.

Extending outwardly (upwardly extending in the orientation shown) from an interior facing surface 48 of the main body portion 42 is a fin or flange 50 for fastening the window unit 10 to the building at a plurality of places spaced about the periphery of the window unit 10, e.g., via nails, screws, or other like fasteners 52 (shown in phantom). Optionally, bores 54 may be pre-drilled or otherwise pre-formed in the nailing flange 50.

Extending outwardly (upwardly extending in the orientation shown) from an exterior facing surface 56 of the main body portion 42 is a casing flange 58. In the depicted embodiment, the casing flange 58 includes an axially extending channel 60, thereby providing a transverse dimension 62, sized, e.g., to give the window unit 10 an exterior appearance of having a traditional wooden casing.

A channel 64 is defined by the nailing flange 50, the main body portion 42 and the casing flange 58. The channel is adapted to receive a siding material (not shown) applied over exterior sheathing material of the building. The siding material may be applied within the channel 64 to cover the nailing flange 50, such that the exterior facing surface of the main body portion 42 and the casing flange 58 combine to give the appearance of a wooden trim material.

The casing member 24 and like exterior casing members 26 may be mitered, or otherwise joined to give an exterior appearance of a miter joint at the corners 34 (FIG. 1), e.g., to give the appearance of wooden casing about the top and vertical sides of the window unit 10. A fastening boss 88 may be formed in the cross-sectional profile of the exterior casing members 24 and 26, e.g., for receiving a screw-type fastener for adjoining the casing members at corners 34 and/or for adjoining the sill member 28 to the vertical casing members 26. As an alternative to mechanical fasteners, or in addition thereto, the exterior casing members may be fastened via a welding process, such as ultrasonic or more preferably hot welding, a bonding process, or the like.

The base member 40 of the casing member 24 engages an outwardly facing (upward in the orientation shown) surface 80 of the frame member 14. The frame member 14, as depicted, includes a plurality of axially extending channels 82 and structurally reinforcing panels 84 formed therein. It will be recognized that the particular pattern of channels and reinforcement panels shown is exemplary only. The base member 40 includes an interiorly extending lip 72 for receiving a plurality of screw or other type of fasteners 74 for adjoining the casing member (24,26) to its corresponding frame section (14, 16).

An exterior facing surface 90 of the frame member 14 includes an axially extending recess 92. An interior facing surface 94 of the frame member likewise has an axially extending recess 96 formed therein. A recess 70 may be formed on the surface 40.

An axially extending fastener 66 is integral with and extends from the base member 40 of the casing member 24. The fastener 66 is adapted to be received within the recess 92 of the frame member 14. In the embodiment depicted, the fastening member 66 has a generally L-shaped or hook-shaped cross-section and preferably includes a tooth or protrusion 68 to provide secure engagement within the recess 92. The combination of the fastener 66 and the screw-type or other fasteners 74 combine to provide a rigid attachment between the exterior casing members and the window frame. This rigid means of attachment improves the structural integrity of the window unit 10 and advantageously allows the pre-attachment of the exterior casing members to the unit off-site, e.g., at a centralized plant or manufacturing facility, thereby reducing installation costs, while also minimizing the likelihood of breakage during storage, handling, and transportation of the completed window constructions.

In the depicted embodiment, the recess 92 and the hook 66 are positioned to provide a generally smooth or flush transition from the exterior facing surface 56 of the casing member 24 and the exterior facing surface 90 of the window frame section 14. A like flush relationship is also preferably provided between the casing members 26 and the frame sections 16.

Optionally, the interior wood casing panel 30 may be pre-attached to the window unit 10. In the depicted embodiment, a generally L-shaped fastener or bracket 102 is secured within a rabbet 100 formed on an interior edge 104 of casing member 30. The L-shaped fastener 102 may be secured via staple, nails, screw, or other fastener 106. The L-shaped bracket may be a single elongate member extending in the axial direction of the frame member 14 and the casing member 30, or, more preferably, may comprise plural discrete fasteners, axially spaced apart along the frame member 14 and the casing member 30.

The L-shaped fastener 102 has a cross-sectional profile adapted to be received within the recess 96 of the frame member 14. In the embodiment depicted, the fastening member 102 includes a tooth or protrusion 108 to provide secure engagement and retention within the recess 96.

Figure 4:
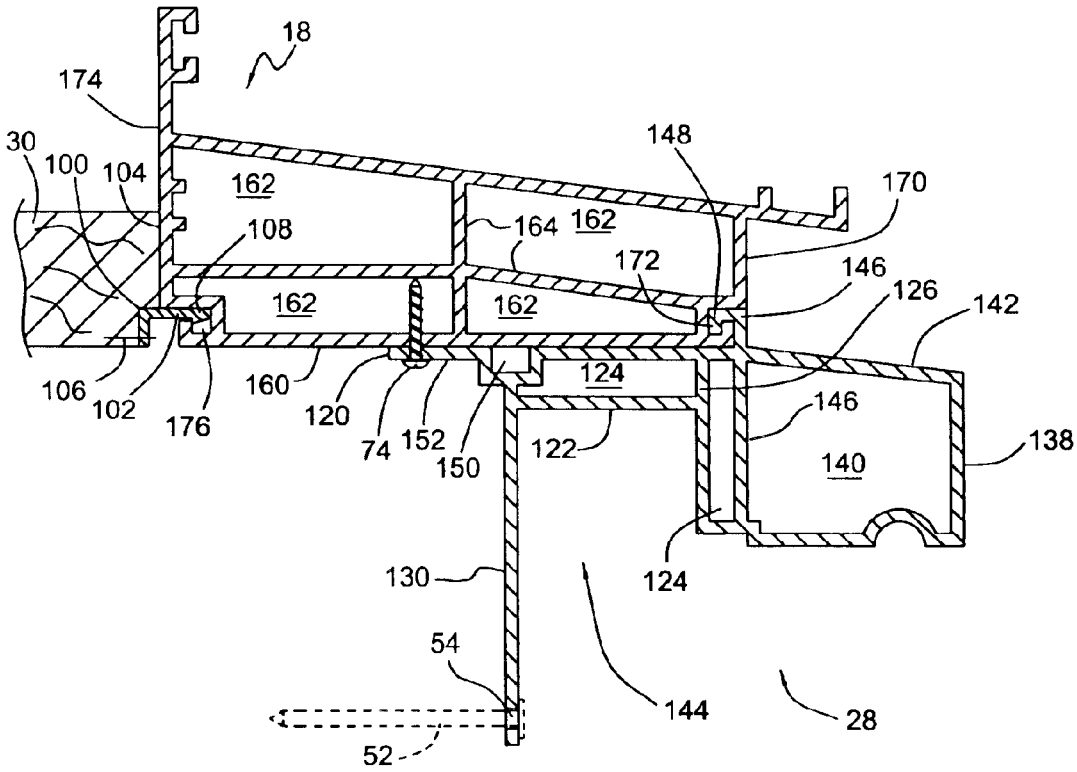
FIG. 4 is an enlarged side-sectional view illustrating an exemplary exterior sill member profile and means of attachment to the window frame.

As best seen in FIG. 4, the exterior sill member 28 and interior casing member 30 is attached to the lower frame section 18 in a manner similar to that described above by way of reference to FIG. 3. The exterior sill 28 includes an upper or mounting surface 120 and a main body portion 122. The main body portion 122 includes axially extending hollow regions 124 and one or more interior structural panels 126. Again, it will be recognized that the pattern of channels and interior structural panels depicted is exemplary only.

Extending outwardly (downwardly in the orientation shown) from the body portion 122 is a nailing fin or flange 130 for fastening the window unit 10 to the building at a plurality of places spaced along the flange 130, e.g., via nails, screws, or other like fasteners 52. Optionally, bores 54 may be pre-drilled or otherwise pre-formed in the nailing flange 130 at a plurality of spaced-apart locations along the nailing flange 130.

Extending in the exterior direction from the body portion 122 is a hollow sill member 138. In the depicted embodiment, the sill member 138 includes an axially extending channel 140, and is preferably of a size and shape having the appearance of a traditional wooden sill. One or more interior reinforcing panels, such as panel 146 may also be provided. In the preferred embodiment, the upper surface 142 of the sill member 138 is sloped downwardly toward the exterior side to allow drainage of moisture away from the interior side of the window 10.

A channel 144 is defined between the nailing flange 130, the main body portion 122 and the sill member 138. The channel is adapted to receive a siding material applied over the exterior sheathing material of the building. The siding material may be applied within the channel 142 to cover the nailing flange 126. The channel 144 in combination with the top channel 64 and like side channels forms an annular channel about the periphery of the window unit 10.

An end cap or plug 148 (see FIG. 1) may be applied to each end of the hollow sill member 138 to close the ends and give the appearance of a traditional, solid wood sill.

The mounting surface 120 of the sill member 28 engages an outwardly facing (downward in the orientation shown) surface 160 of the frame member 18. The frame member 18, as depicted, includes a plurality of axially extending channels 162 and structurally reinforcing panels 164 formed therein. Again, it will be recognized that the cross-sectional profile depicted is exemplary only. The mounting surface 120 further includes an interiorly extending lip 152 for receiving a plurality of screws or other type of fasteners 74 for adjoining the sill member 28 to the frame section 18.

An exterior facing surface 170 of the frame member 18 includes an axially extending recess 172. An interior facing surface 174 of the frame member likewise has an axially extending recess 176 formed therein. A recess 150 may be formed on the surface 120.

An axially extending fastener 146 is integral with and extends from the mounting surface 120 of the exterior sill member 28. The fastening member 146 is adapted to be received within the recess 172 of the frame member 18. In the depicted embodiment, the fastening member 146 has a generally L-shaped or hook-shaped cross-section and preferably includes a tooth or protrusion 148 to provide secure engagement and retention within the recess 172. The combination of the fastener 146 and the fasteners 74 combine to give a rigid attachment between the exterior sill member 18 and the frame section 18. This rigid means attachment improves the structural integrity of the window unit 10 and advantageously allows the pre-attachment of the exterior sill member off-site, e.g., at a centralized plant or manufacturing facility, thus reducing installation costs, while minimizing the likelihood of breakage or damage during storage, handling, and transportation of the completed units.

In the depicted embodiment, the optional interior wood casing panel 30 is shown pre-attached to the window unit 10. Specifically, a generally L-shaped fastener or bracket 102 is secured within a rabbet 100 formed on an interior edge 104 of casing member 30. The L-shaped fastener 102 may be secured via a staple, nail, screw, or other fastener 106. The L-shaped bracket 102 may be an elongate member extending in the axial direction along the frame member 18 and the casing member 30, or, more preferably, may comprise plural discrete fasteners, axially spaced apart along the frame member 18 and the casing member 30.

The L-shaped fastener 102 has a cross-sectional profile adapted to be received within the recess 176 of the frame member 18. In the embodiment depicted, the fastening member 102 includes a tooth or protrusion 108 to provide secure engagement within the recess 176.

In the above embodiment, the window frame sections 14, 16, and 18 and the corresponding exterior casing member 24, 26, or sill member 28 are depicted as separately formed and attached as described above. This advantageously allows like frame members to be employed with or without the exterior casing and sill members, as desired. However, in an alternative embodiment (not shown), each window frame member and its respective exterior casing or sill member may be formed as a single, monolithic extrusion or molded member.

Figure 5:
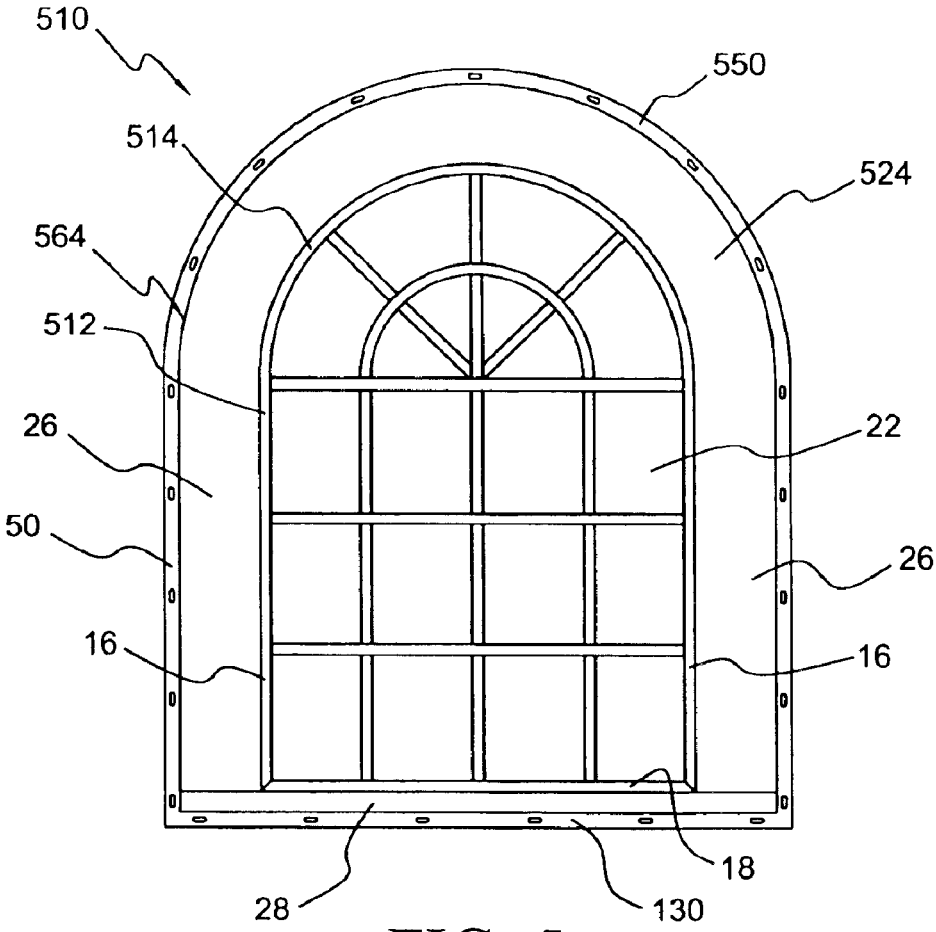
FIGS. 5 and 6 illustrate embodiments of the present invention employing curved frame and casing sections.

Referring now to FIG. 5, the window construction 510 comprises a upper, curved frame member or section 514, two vertically extending frame sections 16, and a base frame member 18, which are attached or joined to form a frame 512 bounding window 22 mounted therein.

An upper, curved exterior casing member 524 and two vertically extending side exterior casing members 26 are attached to the respective upper and side frame sections 514 and 16. An exterior sill member 28 is attached to the lower frame member 18. The exterior casing and sill members are likewise preferably formed via an extrusion process, although other methods, such as molding, are also contemplated. The curved frame and casing members 514 and 524 may be formed by formed, for example, heating a straight extruded member and bending to a desired radius or other curved shape.

The casing members 524, 26, and 28 each include a nailing fin 550, 50, and 130, respectively, defining a peripheral channel 564 about the window 510. Although the curved frame member 514 and the curved casing member 524 are depicted as semi-circular, it will be recognized that other curved shapes may be employed, circular, oval, elliptical, ogival, or portions thereof such as quarter round, hemi-elliptical, and the like, or any other desired curved shape. Likewise, the present invention can be readily adapted to any desired shape, which may be curvilinear, rectilinear, or a combination of rectilinear and curvilinear segments.

Figure 6:
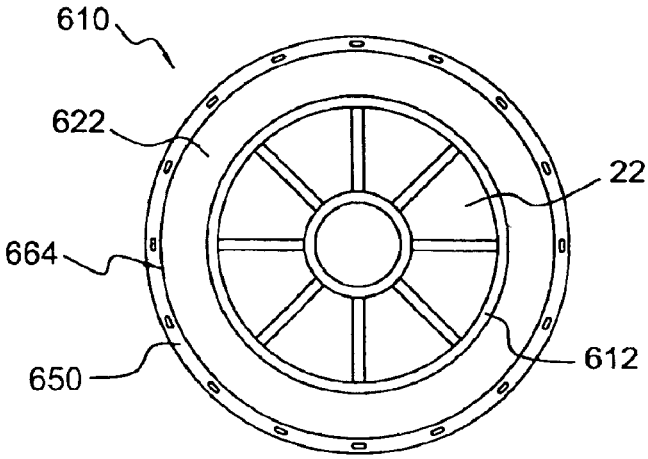

Referring now to FIG. 6, a window construction 610 comprises a curved frame 612, which may be formed from multiple curved segments, attached or joined together, bounding window 22 mounted therein.

A curved exterior casing 622 is attached to the frame 612 and in the case of a segmented frame 612, may be segmented in the same manner. The casing 622 includes a nailing fin 650 and defines a peripheral channel 664 about the edge of the window 610. Although the window member 610 is depicted as circular, it will be recognized that other curved, rectilinear, polygonal, or any other geometrical shape may be employed.

Figure 7:
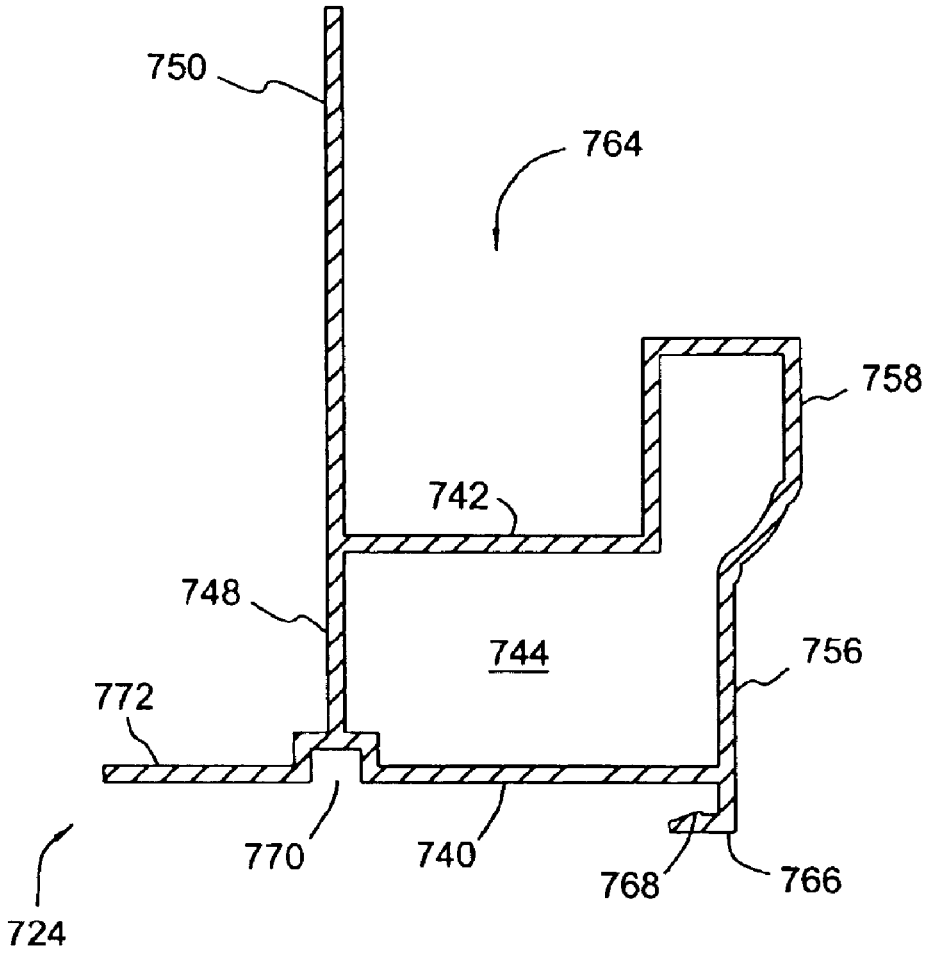
FIG. 7 is a side-sectional view of a further exemplary exterior casing profile in accordance with the present invention.

Referring now to FIG. 7, there is illustrated a profile of an exterior casing member 724 in accordance with a further embodiment of the present invention. The exterior casing member 724 includes a base layer or mounting surface 740 and a main body portion 742. The main body portion includes an axially extending hollow region 744 and may optionally include one or more interior structural panels (not shown).

Extending outwardly (upwardly extending in the orientation shown) from an interior facing surface 748 of the main body portion 742 is a fin or flange 750 for fastening to a building as detailed above.

Extending outwardly (generally upwardly extending in the orientation shown) from an exterior facing surface 756 of the main body portion 742 is a casing flange 758.

A channel 764 is defined by the nailing flange 750, the main body portion 742 and the casing flange 758. The channel is adapted to receive a siding material applied over exterior sheathing material of the building. The siding material may be applied within the channel 764 to cover the nailing flange 750, such that the exterior facing surface of the main body portion 742 and the casing flange 758 combine to give the appearance of a wooden trim material.

Plural casing members 724 may be mitered, or otherwise joined (mechanically fastened or welded) to give an exterior appearance of a miter joint as described above, e.g., to give the appearance of wooden casing about the top and vertical sides of a window unit. Optionally, the casing may be used in conjunction with a sill member, such as sill member 28 (see FIG. 4), or, alternatively, may be used on all sides of a window. The casing member 724 may be straight or curved, as described above.

The base member 740 of the casing member 724 engages an aligned facing surface of a corresponding window frame member, in the same manner as described above.

An axially extending fastener 766 is integral with and extends from the base member 740 of the casing member 724. The fastener 766 is adapted to be received within the a complimentary recess of the window frame member as described above. In the embodiment depicted, the fastening member 766 has a generally L-shaped or hook-shaped cross-section and preferably includes a tooth or protrusion 768 to provide secure engagement within the recess. A screw fastener may also be used to secure the tongue member 772 to the corresponding window frame member as described above to provide a secure, rigid attachment between the exterior casing members and the window frame, thereby minimizing problems of breakage during transport and handling. Advantageously, the hook 766 and the complimentary recess are positioned to provide a generally smooth or flush transition from the exterior facing surface 756 of the casing member 724 and an exterior facing surface of the window frame. It will be further recognized that the casing member 724 may likewise be employed in conjunction with a window frame receiving or adapted to receive an integrated or preattached interior casing or extension jamb as described above.

The invention has been described with reference to the preferred embodiments. Obviously, modifications-and alterations will occur to others upon a reading and understanding of this specification. The forms hereinbefore described being merely explanatory and exemplary, it is intended that the invention be construed as including all such modifications and alterations.

Having thus described the preferred embodiments, the invention is now claimed to be:

1. A window construction for mounting in an opening in a wall of a structure, comprising:

a window frame for being received in said opening in the wall;

an integrated exterior casing fastened to said frame, wherein an exterior-most exterior facing surface of said exterior casing is substantially flush with an adjacent exterior facing surface of said window frame;

said exterior casing comprising a peripheral nailing flange adapted to receive a plurality of spaced-apart fasteners; and said exterior casing being sufficiently rigidly attached to said window frame so as to permit secure attachment of said window construction to said structure via said nailing flange and said plurality of spaced-apart fasteners.

2. The window construction of claim 1, further comprising:

said window frame comprising a lower horizontally extending frame member and at least one additional frame member;

said integrated exterior casing comprising an exterior casing member and fastened to each of said at least one additional frame members and an integrated exterior sill attached to the lower horizontally extending frame member;

said integrated exterior casing and said integrated exterior sill circumscribing said window frame; and each of said at least one exterior casing members and said exterior sill member having a mounting face extending in a direction perpendicular to said wall, said face engaging and rigidly mounted against an aligned, facing surface of the window frame.

3. The window construction of claim 1, wherein said window frame is rectangular.

4. The window construction of claim 1, wherein at least a portion of said window frame is curved and wherein a portion of said exterior casing adjacent to said curved portion of said window frame is curved.

5. The window construction of claim 1, wherein said integrated exterior casing includes a lip adapted to receive a plurality of spaced apart fasteners for securing said lip to said window frame.

6. The window construction of claim 1, wherein said exterior casing further comprises a generally L-shaped bracket engaging a complimentary recess formed on said window frame.

7. The window construction of claim 1, further comprising an integrated interior casing adapted to generally inscribe said opening in the structure.

8. The window construction of claim 1, wherein said exterior casing further comprises a peripheral channel adapted to receive a siding material applied to an exterior surface of said building.

9. The window construction of claim 1, wherein the exterior casing is configured to give an appearance of a wooden window casing.

10. A window construction for mounting in an opening in a wall of a structure, comprising:

a rectangular window frame for being received in said opening in the wall, said window frame having upper and lower horizontally extending frame members and first and second vertically extending frame members, said window frame adapted to carry one or more window sashes;

an integrated exterior casing comprising a first exterior casing member fastened to the upper horizontally extending frame member and second and third integrated casing members fastened to the first and second vertically extending frame members, respectively, wherein each of said first, second, and third exterior casing members comprise an exterior-most exterior facing surface which is substantially flush with an adjacent exterior facing surface of said window frame;

an integrated exterior sill attached to the lower horizontally extending frame member;

said integrated exterior casing and said integrated exterior sill circumscribing said window frame including a peripheral nailing flange adapted to receive a plurality of spaced-apart fasteners; and said integrated exterior casing and said integrated exterior sill being sufficiently rigidly attached to said window frame so as to permit secure attachment of said window construction to said structure via said nailing flange and said plurality of spaced-apart fasteners.

11. The window construction of claim 10, further comprising two sashes vertically slideably received within said window frame.

12. The window construction of claim 10, wherein said integrated exterior casing and said integrated exterior sill each include a lip adapted to receive a plurality of spaced apart fasteners for securing said lip to said window frame.

13. The window construction of claim 12, wherein said plurality of spaced apart fasteners for securing said lip to said window frame are screw-type fasteners.

14. The window construction of claim 10, wherein each of said exterior casing members and said exterior sill member further comprise a generally L-shaped bracket engaging a complimentary recess formed on said window frame.

15. The window construction of claim 14, wherein each of said L-shaped brackets comprises a first leg portion which forms a portion of an exterior facing surface of said casing member, and a second leg portion engaging said complimentary recess.

16. The window construction of claim 10, wherein said integrated exterior casing and said integrated exterior sill further comprise a peripheral channel adapted to receive a siding material applied to an exterior surface of said building.

17. The window construction of claim 10, wherein the exterior casing members are configured to give an appearance of a wooden window casing and wherein the exterior sill member is configured to give an appearance of a wooden sill.

18. A window construction for mounting in an opening in a wall of a structure, comprising:

a rectangular window frame for being received in said opening in the wall, said window frame having upper and lower horizontally extending frame members and first and second vertically extending frame members, said window frame adapted to carry one or more window sashes;

an integrated exterior casing comprising a first exterior casing member fastened to the upper horizontally extending frame member and second and third integrated casing members fastened to the first and second vertically extending frame members, respectively;

an integrated exterior sill attached to the lower horizontally extending frame member;

said integrated exterior casino and said integrated exterior sill circumscribing said window frame including a peripheral nailing flange adapted to receive a plurality of spaced-apart fasteners:

said integrated exterior casing and said integrated exterior sill being sufficiently rigidly attached to said window frame so as to permit secure attachment of said window construction to said structure via said nailing flange and said plurality of spaced-apart fasteners; and an integrated interior casing adapted to generally inscribe said opening in the structure, said integrated interior casing including a peripheral channel formed about an edge of said interior casing, and a fastener secured within said channel and engaging an interior facing surface of said window frame.

19. The window construction of claim 18, wherein each of said first, second, and third exterior casing members comprise an exterior-most exterior facing surface which is substantially flush with an adjacent exterior facing surface of said window frame.

20. The window construction of claim 18, wherein said integrated interior casing comprises wooden panels.

21. A window construction for mounting in an opening in a wall of a structure, comprising:

a window frame for being received in said opening in the wall;

an integrated exterior casing fastened to said frame;

said exterior casing comprising a peripheral nailing flange adapted to receive a plurality of spaced-apart fasteners;

said exterior casing being sufficiently rigidly attached to said window frame so as to permit secure attachment of said window construction to said structure via said nailing flange and said plurality of spaced-apart fasteners;

an integrated interior casing adapted to generally inscribe said opening in the structure, said integrated interior casing comprising a peripheral channel formed about an edge of said interior casing, and a fastener secured within said channel and engaging an interior facing surface of said window frame.

22. The window construction of claim 21, wherein each of said first, second, and third exterior casing members comprise an exterior-most exterior facing surface which is substantially flush with an adjacent exterior facing surface of said window frame.

23. A method for manufacturing a window construction for installing within an opening formed in a wall of a structure, comprising:

forming a window frame for being received in said opening in the wall;

forming an integrated exterior casing including a peripheral nailing flange adapted to receive a plurality of spaced-apart fasteners;

prior to installing the window construction in the opening in said structure, attaching said integrated exterior casing to the window frame in sufficiently rigid fashion so as to allow secure attachment of said window construction to the wall of the structure via said nailing flange and said plurality of spaced-apart fasteners and such that an exterior-most exterior facing surface of said exterior casing members is substantially flush with an adjacent exterior facing surface of said window frame.

24. The method of claim 23, wherein said integrated exterior casing is formed separately from the window frame.

25. The method of claim 23, wherein at least a portion of the exterior casing and a portion of the window frame are monolithically formed at the same time.

26. The method of claim 23, wherein said attaching is performed at a centralized location prior to transporting the window to the structure.

27. The method of claim 23, wherein said exterior casing comprises a mounting face extending in a direction perpendicular to said wall, and further wherein said attaching comprises aligning and fastening said mounting face against an aligned, facing surface of the window frame.

28. The method of claim of claim 23, further comprising:

said window frame forming a rectangular window frame having upper and lower horizontally extending frame members and first and second vertically extending frame members, said window frame adapted to carry one or more window sashes; and said integrated exterior casing comprising a first exterior casing member fastened to the upper horizontally extending frame member and second and third integrated casing members fastened to the first and second vertically extending frame members, respectively, and an integrated exterior sill attached to the lower horizontally extending frame member.

29. A method for manufacturing a window construction for installing within an opening formed in a wall of a structure, comprising:

forming a window frame for being received in said opening in the wall;

forming an integrated exterior casing including a peripheral nailing flange adapted to receive a plurality of spaced-apart fasteners;

prior to installing the window construction in the opening in said structure, attaching said integrated exterior casing to the window frame in sufficiently rigid fashion so as to allow secure attachment of said window construction to the wall of the structure via said nailing flange and said plurality of spaced-apart fasteners; and prior to installing the window construction in the opening in said structure, attaching an integrated interior casing adapted to generally inscribe said opening in the structure.

30. The method of claim 29, wherein said attaching comprises aligning and fastening said exterior casing such that an exterior-most exterior facing surface of said exterior casing members is substantially flush with an adjacent exterior facing surface of said window frame.

31. The method of claim 29, further comprising:

said window frame forming a rectangular window frame having upper and lower horizontally extending frame members and first and second vertically extending frame members, said window frame adapted to carry one or more window sashes; and said integrated exterior casing comprising a first exterior casing member fastened to the upper horizontally extending frame member and second and third integrated casing members fastened to the first and second vertically extending frame members, respectively, and an integrated exterior sill attached to the lower horizontally extending frame member.

* * * * *